US011913144B2

(12) United States Patent
Myogi et al.

(10) Patent No.: US 11,913,144 B2
(45) Date of Patent: Feb. 27, 2024

(54) LOOM

(71) Applicant: TSUDAKOMA KOGYO KABUSHIKI KAISHA, Ishikawa-ken (JP)

(72) Inventors: Keiichi Myogi, Ishikawa-ken (JP); Daigo Yamagishi, Ishikawa-ken (JP); Koichi Tamura, Ishikawa-ken (JP); Kazuya Yama, Ishikawa-ken (JP)

(73) Assignee: TSUDAKOMA KOGYO KABUSHIKI KAISHA, Ishikawa-Ken (JP)

( * ) Notice: Subject to any disclaimer, the term of this patent is extended or adjusted under 35 U.S.C. 154(b) by 11 days.

(21) Appl. No.: 17/483,099

(22) Filed: Sep. 23, 2021

(65) Prior Publication Data

US 2022/0127763 A1 Apr. 28, 2022

(30) Foreign Application Priority Data

Oct. 27, 2020 (JP) ..... 2020-179827

(51) Int. Cl.
*D03D 49/02* (2006.01)

(52) U.S. Cl.
CPC ..... *D03D 49/025* (2013.01)

(58) Field of Classification Search
None
See application file for complete search history.

(56) References Cited

U.S. PATENT DOCUMENTS 4,957,143 A * 9/1990 Takahashi ..... D03D 49/60 139/190
7,073,537 B2 * 7/2006 Wahhoud ..... D03D 49/60 139/50

FOREIGN PATENT DOCUMENTS

| | | | | |
|---|---|---|---|---|
| CN | 204311195 U | | 5/2015 | |
| EP | 1600540 A1 | * | 11/2005 | ..... D03D 49/60 |
| EP | 1600540 A1 | | 11/2005 | |
| JP | 2005-336669 A | | 12/2005 | |
| JP | 2006-291380 A | | 10/2006 | |
| JP | 2006291380 A | * | 10/2006 | ..... B23C 3/305 |

OTHER PUBLICATIONS

Mar. 7, 2022, European Search Report issued for related EP Application No. 21199446.2.

* cited by examiner

*Primary Examiner* — Grace Huang
(74) *Attorney, Agent, or Firm* — Paratus Law Group, PLLC

(57) ABSTRACT

A loom includes a pair of support shafts each provided to each of a pair of side frames and configured to rock, a rocking shaft connected to both the support shafts and bridged between the support shafts, a bearing structure comprising a bearing configured to rotatably support the rocking shaft, and a support body having an attaching surface, which is a surface to which the bearing structure is attached, and provided to extend in a weaving width direction. The support body has a position adjusting surface parallel to the attaching surface on at least one of both ends in a length direction.

2 Claims, 3 Drawing Sheets

LOOM

CROSS-REFERENCE TO RELATED APPLICATION(S)

This application is based on and claims priority under 35 USC 119 from Japanese Patent Application No. 2020-179827 filed on Oct. 27, 2020, the contents of which are incorporated herein by reference.

TECHNICAL FIELD

The present invention relates to a loom including a pair of support shafts each provided to each of a pair of side frames and configured to rock, a rocking shaft connected to both the support shafts and bridged between the support shafts, a bearing structure including a bearing configured to rotatably support the rocking shaft, and a support body having an attaching surface, which is a surface to which the bearing structure is attached, and provided to extend in a weaving width direction.

BACKGROUND ART

A loom has a pair of support shafts configured to rock in conjunction with rotation of a main shaft. Note that, the support shafts are each provided to each of left and right side frames of the loom and are provided in such an aspect that one end portion thereof protrudes from each side frame toward an inner side in a weaving width direction. A rocking shaft of a beating device is connected to both the support shafts. Thereby, the rocking shaft is in a state of being bridged between the pair of support shafts. In addition, the rocking shaft is also supported on a bearing structure via a bearing in the state of being bridged between the support shafts. Note that, the bearing structure is attached to a support body provided to extend in the weaving width direction.

For example, Patent Literature 1 discloses a loom having a bearing structure. In the loom disclosed in Patent Literature 1, the bearing structure (intermediate support unit) is provided in a form of being placed on a plate attached to a beam extending in the weaving width direction and bridged between left and right side frames of the loom. The bearing structure is constituted by a bearing holder and a bearing cover as a shaft support part constituting the bearing, and an L-shaped bracket as a base part configured to support the shaft support part and attached to the plate.

CITATION LIST

Patent Literature

Patent Literature 1: JP2005-336669A

SUMMARY OF INVENTION

As described above, the rocking shaft is rocked about shaft centers of the support shafts connected to both ends of the rocking shaft, as a center of rocking. For this reason, in a state where the bearing structure configured to support the rocking shaft is mounted on the plate, as described above, a center of the bearing of the shaft support part of the bearing structure is required to substantially match the shaft centers of the support shafts, as seen in the weaving width direction. Therefore, an initial state where the bearing structure is mounted on the plate is set based on a positional relationship in an upper and lower direction between the plate and the shaft centers of the support shafts at a time when attached to a preset position on the loom, for example. Specifically, in the initial state, the bearing structure is configured so that a positional relationship between a surface (placement surface) placed on the plate and the center of the bearing matches the positional relationship on the support shaft-side.

However, since the beam or place on which the bearing structure is mounted is a long member, bending or the like may occur thereon over a length direction, in many cases. For this reason, when the bearing structure configured in the initial state as described above is mounted on the plate, as it is, the center of the bearing and the center of the support shaft do not match each other, as seen in the weaving width direction.

Therefore, the bearing structure of Patent Literature 1 is configured so that the shaft support part can be positionally adjusted in the upper and lower direction with respect to the base part configured to support the shaft support part. In this configuration, an operation of mounting the bearing structure in the initial state as described above on the plate and adjusting the position of the shaft support part with respect to the base part so that the center of the bearing matches the shaft center of the support shaft, as seen in the weaving width direction, is performed.

However, since a position in which the bearing structure is provided is a position largely spaced from the support shaft in the weaving width direction, it is very difficult and troublesome to adjust the center of the bearing to the shaft center of the support shaft. For this reason, the adjusting operation is time-consuming and places a heavy burden on an operator. Further, in order to enable the adjusting, since it is necessary to constitute the bearing structure in such a form that the base part and the shaft support part are combined, the configuration of the bearing structure becomes complicated.

It is therefore an object of the present invention to provide a structure of a loom where a bearing structure has a simpler structure and an adjusting operation on the bearing structure is not required so as to reduce a burden on an operator as much as possible.

In order to achieve the above object, the present invention having the above-described loom as a preamble is characterized in that the support body to which the bearing structure is attached on the attaching surface has a position adjusting surface parallel to the attaching surface on at least one of both ends in a length direction. Further, in the present invention, the bearing structure may be formed as a single structure including a shaft support part to which the bearing is provided and a base part that is attached to the attaching surface.

According to the loom of the present invention, the support body has the position adjusting surface parallel to the attaching surface on at least one of both ends in the length direction. Specifically, the support body has the position adjusting surface formed parallel to the attaching surface in a position closer to the support shaft than the attaching surface. According to the loom having the support body configured as described above, since the position adjusting surface is a surface formed parallel to the attaching surface on the basis of the attaching surface, it is possible to easily perceive a positional relationship between the position adjusting surface and the attaching surface.

Therefore, a positional relationship between the position adjusting surface and the support shaft is set based on the positional relationship between the position adjusting surface and the attaching surface, which can be perceived in advance, and a positional relationship between the placement surface of the bearing structure and the center of the bearing. In addition, the support body is arranged on the loom so that the position adjusting surface and the support shaft meet the positional relationship set in this way. As a result, the center of the bearing of the bearing structure mounted on the attaching surface of the support body matches the shaft center of the support shaft in the mounted state, as seen in the weaving width direction. Therefore, according to the loom of the present invention, it is not necessary to perform the adjusting operation on the bearing structure, which is performed in the related art. As a result, the time required for the attaching operation of the loom is shortened and the burden on the operator is also reduced as much as possible.

Further, in the loom of the present invention, since it is not necessary to perform the adjusting operation on the bearing structure, the bearing structure can be formed as a single structure where the shaft support part to which the bearing is provided and the base part that is attached to the attaching surface are integrally formed. When the bearing structure is constituted in this way, the configuration of the bearing structure itself is simplified, as compared to a case where the bearing structure is constituted by a combination of a plurality of parts, like the related art. In addition, when the bearing structure is formed as such a single structure, the rigidity of the entire bearing structure is improved and it is possible to further cope with the high-speed operation of the loom.

DESCRIPTION OF EMBODIMENTS

Figure 1:
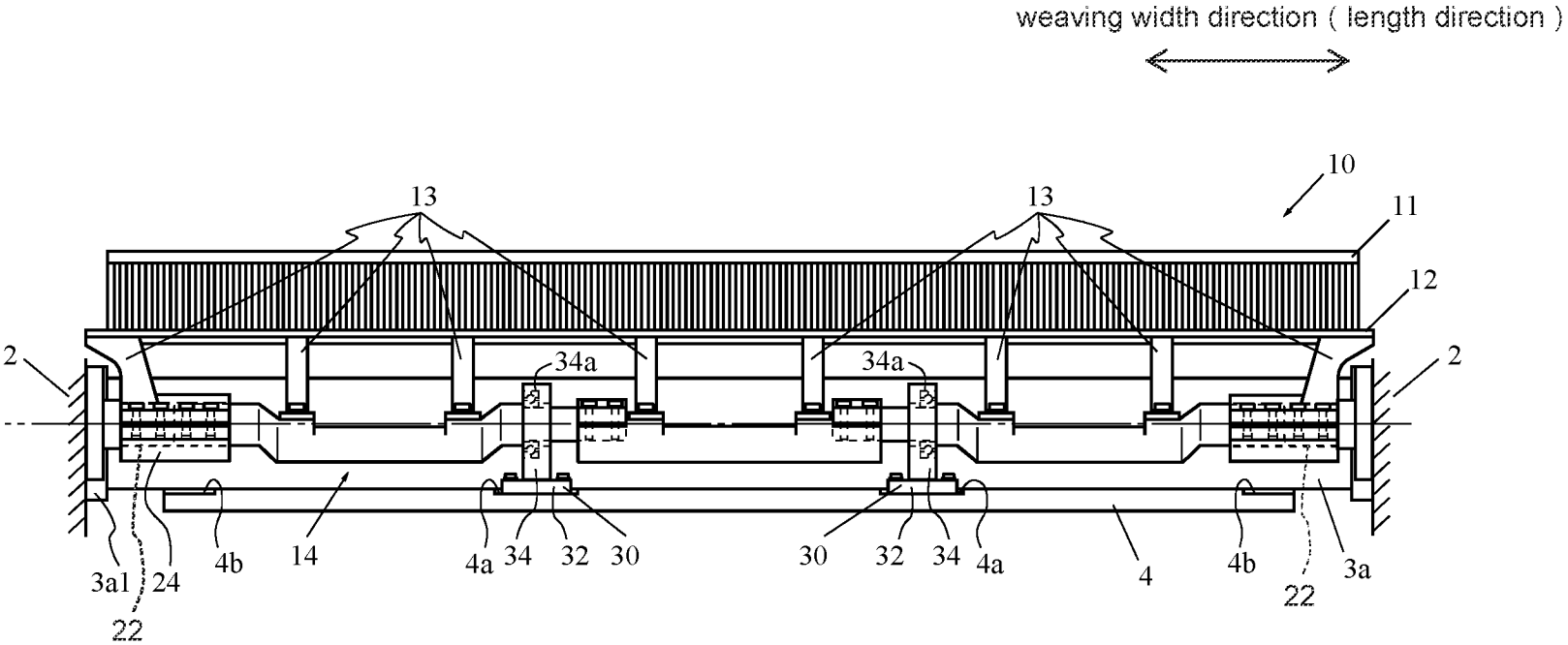
FIG. 1 is a front view of a loom according to an embodiment of the present invention.
Figure 2:
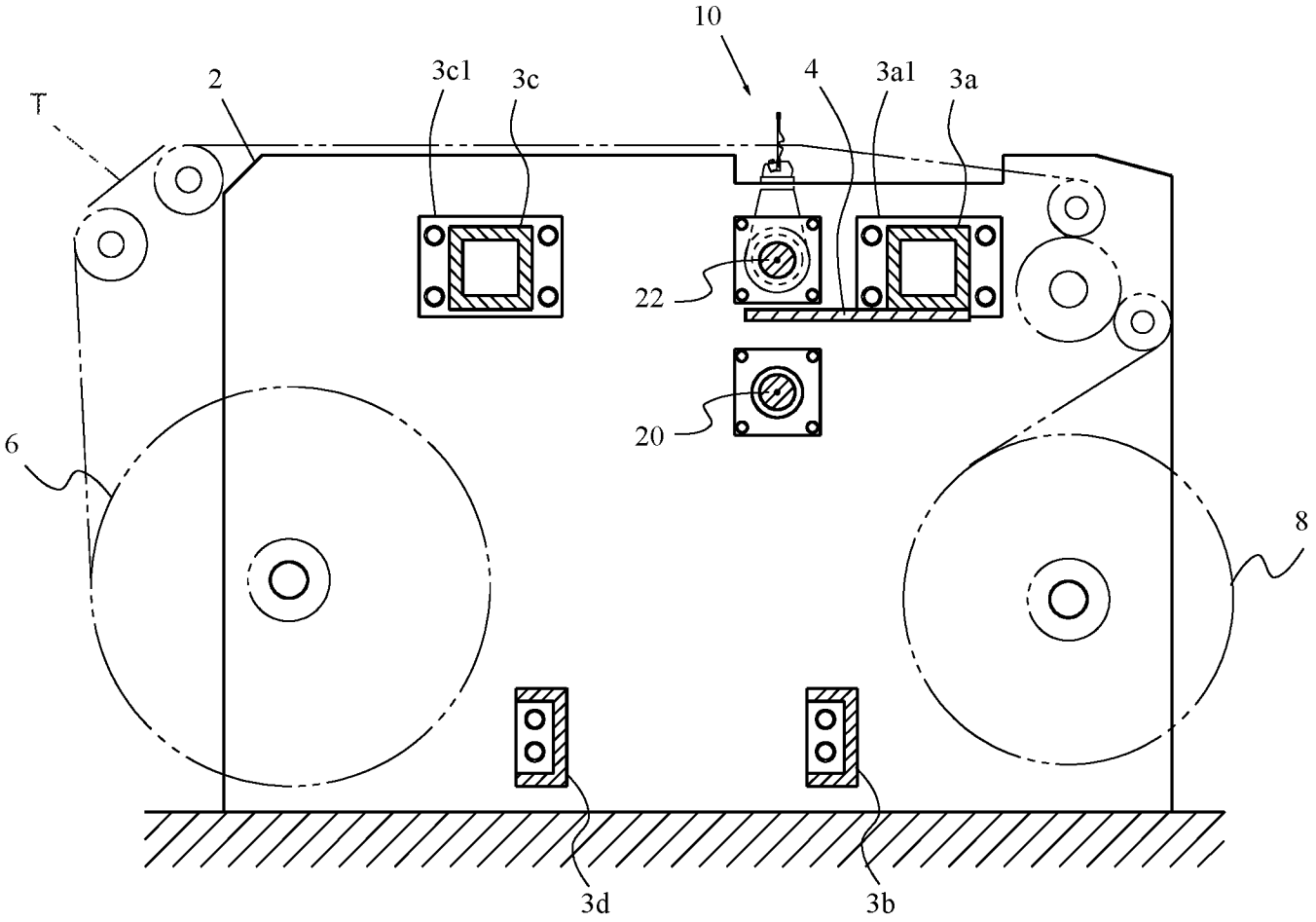
FIG. 2 is a sectional side view of the loom according to the embodiment of the present invention.
Figure 3:
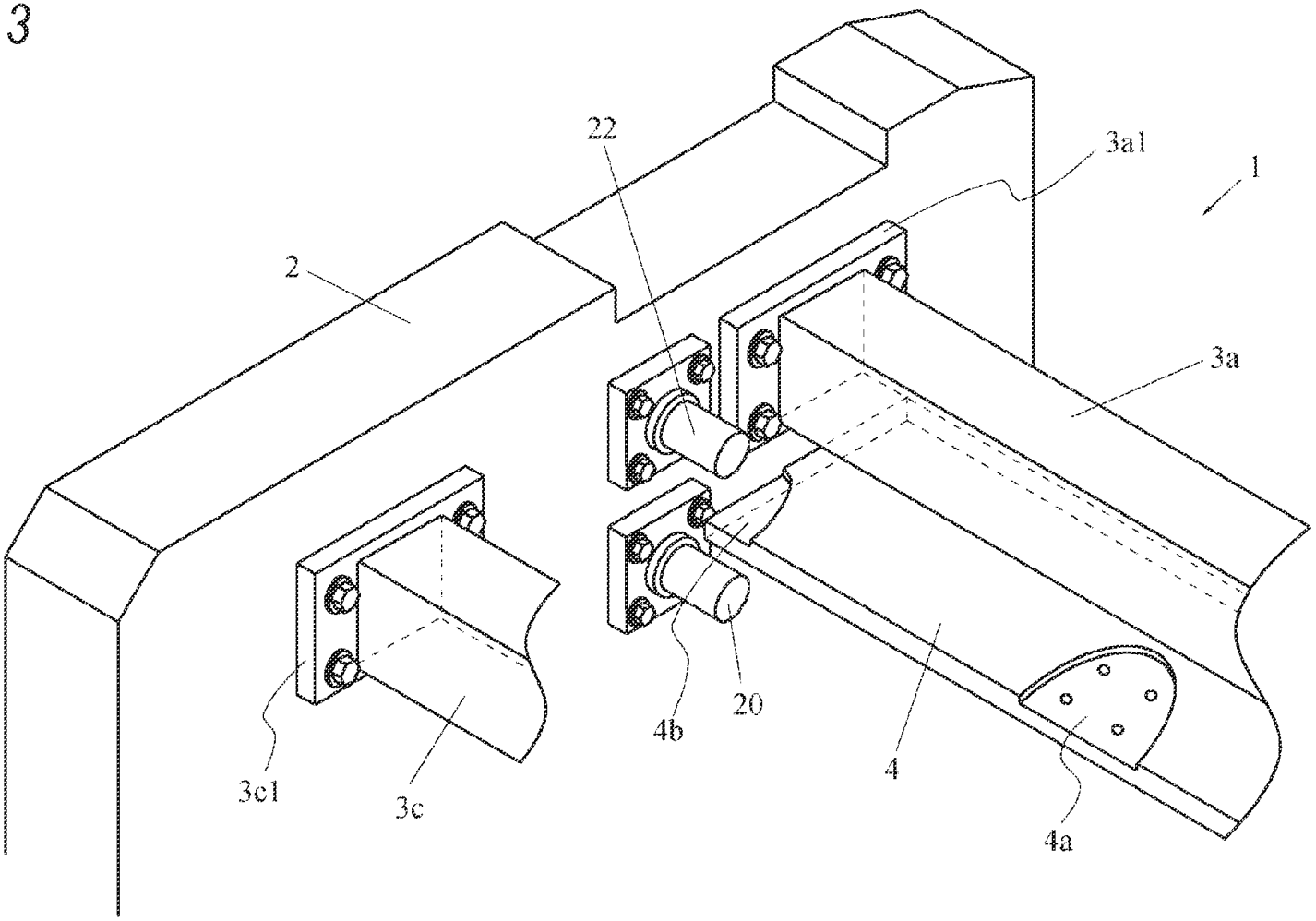
FIG. 3 is a partially enlarged perspective view of the loom according to the embodiment of the present invention.

Hereinafter, an embodiment of a loom to which the present invention is applied will be described with reference to FIGS. 1 to 3.

In a loom, a frame 1 has a pair of side frames 2 and 2, as a main body, and both the side frames 2 and 2 are connected by four beam members 3*a*, 3*b*, 3*c* and 3*d*. In the loom, a warp beam 6 for delivering a warp T is provided on one side (rear side) in a front and rear direction of the loom in a form of being supported on both the side frames 2 and 2. In addition, a winding beam 8 for winding a manufactured woven fabric is provided on the other side (front side) in the front and rear direction of the loom in a form of being supported on both the side frames 2 and 2.

As for the four beam members, the beam members 3*a* and 3*b* arranged on the winding beam 8-side in the front and rear direction are arranged in different positions in an upper and lower direction, the upper beam member 3*a* is a so-called front top stay, and the lower beam member 3*b* is a so-called front bottom stay. The beam members 3*c* and 3*d* arranged on the warp beam 6-side in the front and rear direction are also arranged in different positions in the upper and lower direction, the upper beam member 3*c* is a so-called rear top stay, and the lower beam member 3*d* is a so-called rear bottom stay.

The front top stay 3*a* and the rear top stay 3*c* each have flanges 3*a*1, 3*c*1 formed at both end portions thereof. Both the flanges 3*a*1 and 3*a*1 of the front top stay 3*a* are provided to the front top stay 3*a* so that positions match each other, as seen in a length direction of the front top stay 3*a*. Likewise, both the flanges 3*c*1 and 3*c*1 of the rear top stay 3*c* are also provided to the rear top stay 3*c* so that positions match each other, as seen in a length direction of the rear top stay 3*c*.

The front top stay 3*a* and the rear top stay 3*c* are fixed to each of the side frames 2 and 2 in such a form that bolts for fixing inserted in through-holes formed in each of the flanges 3*al* and 3*d* are screwed into the side frames 2 and 2. The front bottom stay 3*b* and the rear bottom stay 3*d* are each a beam member having a substantially U-shaped section and each have end walls formed at both end portions so as to close end portions. The front bottom stay 3*b* and the rear bottom stay 3*d* are also fixed to each of the side frames 2 and 2 in such a form that bolts for fixing inserted in through-holes formed in each of the end walls are screwed into the side frames 2 and 2.

The loom also has a drive shaft 20 configured to rotationally drive a main shaft (not shown), and a support shaft 22 configured to rock in conjunction with rotation of the main shaft (drive shaft 20 configured to drive the main shaft). Note that, the drive shaft 20 and the support shaft 22 are provided in the vicinity of a rear side (warp beam 6-side) of the front top stay 3*a* with respect to the front and rear direction. The support shaft 22 is located in a position within a presence range of the front top stay 3*a* with respect to the upper and lower direction. The drive shaft 20 is located below the support shaft 22. The drive shaft 20 and the support shaft 22 are provided in such a form that one of the end portions thereof protrude inwardly from each of the side frames 2 and 2 in the weaving width direction.

The loom also has a beating device 10 configured to rock a reed 11. In the beating device 10, the reed 11 is supported on a rocking shaft 14 via a sley 12 and sley swords 13. Note that, in the shown example, the rocking shaft 14 is constituted by connecting a plurality of shaft members in a length direction. The rocking shaft 14 is connected at both end portions thereof to support shafts 22 and 22 protruding from both the side frames 2 and 2 via coupling members 24 and 24. Thereby, the rocking shaft 14 is provided to extend in the weaving width direction, in a form of being bridged between both the support shafts 22 and 22 on both the side frames 2 and 2.

In the beating device 10, the rocking shaft 14 is connected to each of the support shafts 22 and 22 and supported on both the support shafts 22 and 22 and is also supported by bearing structures 30 supported on the front top stay 3*a*. In the present embodiment, the bearing structures 30 are attached to a support plate 4 fixed to the front top stay 3*a* and are thus supported on the front top stay 3*a* via the support plate 4.

Specifically, the plate-shaped support plate 4 is fixed to the front top stay 3*a*. The support plate 4 is a plate member having a rectangular shape, as seen in a plate thickness direction, and is formed as a member whose size in a long side direction (length direction) of both end faces in the plate thickness direction is slightly smaller than a size in the length direction of the front top stay 3*a* of the frame 1 and a size in a short side direction is larger than a size of the front top stay 3*a* in the front and rear direction. The support plate 4 is fixed to the front top stay 3*a* in such a form that one of both the end faces is in contact with a lower surface of the front top stay 3*a*, in a direction in which the long side direction is made to match the length direction (weaving width direction) of the front top stay 3*a*. Therefore, the one end face of the support plate 4 becomes a surface (upper surface) facing upward on the loom.

The fixing of the support plate 4 is performed in a state where a side edge of one end-side in the short side direction is made to match an end of the front side (winding beam 8-side) of the front top stay 3*a* with respect to the front and rear direction. Therefore, in a state of being fixed to the front top stay 3*a* in this way, the support plate 4 protrudes toward the rear side (warp beam 6-side) of the front top stay 3*a*. In addition, in the state of being fixed to the front top stay 3*a* in this way, the support plate 4 is positioned below the support shaft 22 and above the drive shaft 20 with respect to the upper and lower direction. Additionally describing, the fixing of the support plate 4 to the front top stay 3*a* is performed in a form of attachment using a screw member (a bolt and the like), fixing by welding, or the like.

The bearing structure 30 also has a bearing 34*a* for rotatably supporting the rocking shaft 14, and is constituted by a shaft support part 34 having the bearing 34*a* embedded therein, as a main body. The bearing structure 30 also has a base part 32 which the shaft support part 34 is erected thereon and is attached to the support plate 4. In the present embodiment, the bearing structure 30 is formed as a single structure including the base part 32 and the shaft support part 34. The bearing structure 30 is attached to the support plate 4 in such a form that bolts for fixing inserted in a plurality of through-holes formed in the base part 32 are screwed into the support plate 4. The attachment is performed in a preset position on the support plate 4 (the upper surface), and an attaching position (attaching part) of the upper surface to which the bearing structure 30 is attached is an attaching surface 4*a* of the support plate 4.

In the shown example, the two bearing structures 30 are provided so as to support the rocking shaft 14 at two places between the support shafts 22 and 22. In other words, the support plate 4 is provided at two places with the attaching surfaces 4*a* to which the bearing structures 30 are attached. In the present embodiment, a combination of the support plate 4 having the attaching surfaces 4*a* to which the bearing structures 30 are attached and the front top stay 3*a* to which the support plate 4 is fixed is the support body of the present embodiment.

In the loom as described above, according to the present invention, the support body including the attaching surface to which the bearing structure is attached is formed to have a position adjusting surface parallel to the attaching surface, on at least one of both end portions in the length direction. In the present embodiment, the support plate 4 of the support body is formed to have position adjusting surfaces 4*b* and 4*b* parallel to both the attaching surfaces 4*a* and 4*a* on the upper surface, on both end portions in the long side direction. The support plate 4 of the present embodiment is described in detail, as follows.

In the present embodiment, each attaching surface 4*a* of the support plate 4 is processed in such a form that a range including a part of the upper surface, to which each bearing structure 30 is attached, is cut out so as to be further recessed than a part around the range. A bottom surface 4*a* of the recessed part is provided as the attaching surface for the bearing structure 30. Both the attaching surfaces 4*a* and 4*a* are formed to be parallel to each other. In addition, both the attaching surfaces 4*a* and 4*a* are formed so that positions (height positions) in the upper and lower direction match each other in a state (attached state) where the support body is attached to both the side frames 2 and 2. The attached state indicates a state where the support body is attached to both the side frames 2 and 2 in such a form that both the attaching surfaces 4*a* and 4*a* are parallel to an axis line direction of the support shaft 22.

In addition, at both end portions (portions in the vicinity of the support shafts 22) of the support plate 4 in the long side direction, parts on the upper surface further protruding rearward than the front top stay 3*a* are cut out so as to be further recessed than a part around the protruding part. Bottom surfaces 4*b* and 4*b* of both the recessed parts are formed parallel to both the attaching surfaces 4*a* and 4*a* and are provided as the position adjusting surfaces of the present invention. Both the position adjusting surfaces 4*b* and 4*b* are also formed so that the height positions match each other and also match the height positions of both the attaching surfaces 4*a* and 4*a* in the attached state.

In the present embodiment, the support plate 4 is configured as described above, so that it is possible to easily implement a state where centers of the bearings 34*a* and 34*a* of both the bearing structures 30 and 30 match shaft centers of both the support shafts 22 and 22, as seen in the weaving width direction.

Specifically, each bearing structure 30 of the present embodiment is formed as a single structure, as described above. Thereby, in a state where the bearing structure 30 is attached to the attaching surface 4*a*, a distance from the attaching surface 4*a* to the center of the bearing 34 is predetermined. In addition, both the attaching surfaces 4*a* and 4*a* and both the position adjusting surfaces 4*b* and 4*b* are formed so that the height positions match each other in the attached state.

Therefore, a distance in the upper and lower direction from both the position adjusting surfaces 4*b* and 4*b* to the shaft centers of both the support shafts 22 and 22 is made to match the distance from the attaching surface 4*a* to the center of the bearing 34*a*, so that the centers of the bearings 34*a* and 34*a* of both the bearing structures 30 and 30 are made to match the shaft centers of the support shafts 22, as seen in the weaving width direction. Therefore, when attaching the support body to both the side frames 2 and 2, the attaching is performed in such a form that the positional relationship (distance) between both the position adjusting surfaces 4*b* and 4*b* and the shaft centers of both the support shafts 22 and 22 is matched in this way. As a result, it is possible to easily implement a state where the centers of both the bearings 34*a* and 34*a* and the shaft centers of both the support shafts 22 and 22 are matched as seen in the weaving width direction.

In the above, one embodiment (hereinafter, referred to as 'above embodiment') of the loom to which the present invention is applied has been described. However, the present invention is not limited to the configuration described in the above embodiment, and can also be implemented in other embodiments (modified embodiments) as described below.

(1) As for the position adjusting surface, in the above embodiment, at both end portions of the support plate 4 of the support body in the long side direction, parts on the upper surface are cut out so as to be recessed, and the bottom surfaces 4*b* and 4*b* of the recessed parts are provided as the position adjusting surfaces. In the attached state, both the position adjusting surfaces 4*b* and 4*b* are formed so that they are parallel to the attaching surfaces 4*a* and 4*a* for the bearing structures 30 and 30 and the height positions match each other. However, in the present invention, the position adjusting surface may be a surface formed parallel to the attaching surface, and is not limited to the surface formed so that the height position in the attached state matches the attaching surface.

Note that, in this case, when determining the attaching positions of the support body to both the side frames, the height positions of the position adjusting surface and the attaching surface are obtained in advance. Then, from a difference in the height position between both the surfaces and a distance obtained in advance between the attaching surface and the bearing of the bearing structure, a distance between the position adjusting surface the shaft center of the support shaft, at which the center of the bearing and the shaft center of the support shaft match each other, may be obtained. The position of the support body in which the distance between the position adjusting surface and the shaft center of the support shaft is the obtained distance becomes the attaching position of the support body.

In addition, the position adjusting surface is not limited to the configuration where it is formed on the upper surface of the support plate 4. For example, the position adjusting surfaces may also be formed on a surface (lower surface) facing downward on the loom so that they are parallel to the attaching surfaces 4*a* on the support plate 4, at both end portions of the support plate 4. Further, the position adjusting surface is not limited to the configuration where it is formed on the support plate. For example, the position adjusting surfaces may be formed on an upper surface or a lower surface in the upper and lower direction at both end portions of the beam member of the support body. Further, the position adjusting surface may be formed on at least one of both end portions of the support body in the length direction. For example, the position adjusting surface may be formed on only one end portion of the support plate or beam member of the above embodiment.

Additionally describing, in the above embodiment, the attaching of the support body is performed in such an aspect that the position of the position adjusting surface with respect to the shaft center of the support shaft is matched to the position becoming the distance obtained in advance with the shaft center of the support shaft. However, in the present invention, the part to which the position of the position adjusting surface is matched is not limited to the support shaft and may also be a specific part (for example, the side frame) on the loom. In this case, the specific part on the loom is a part parallel to the position adjusting surface in the attached state of the support body.

(2) As for the support body including the attaching surface, in the above embodiment, the support body is constituted by the combination of the front top stay 3*a* and the support plate 4, and the attaching surface is provided on the upper surface of the support plate 4. However, in the present invention, the support body is not limited to the configuration where the attaching surface is provided on the support plate, and may also be configured so that the attaching surface is provided on the front top stay. In this case, the support plate of the support body may be omitted.

Note that, in the case where the attaching surface is provided on the front top stay, specifically, the attaching surface is provided on a surface (a rear side surface) of the front top stay facing rearward. In this case, the bearing structure is attached to the rear side surface, and the shaft support part is provided in a form of extending rearward. Also, in this case, the position adjusting surface may be formed on the rear side surface, as a surface parallel to the attaching surface. However, when the support body has a surface that faces in the same direction as the rear side surface and the position adjusting surface can be formed thereon, the position adjusting surface may be formed on the surface.

As for the attaching surface of the support body, in the above embodiment, the part, to which the bearing structure 30 is attached, on the upper surface of the support plate 4 is processed, and the bottom surface 4*a* of the recessed part formed by the processing is provided as the attaching surface. The attaching surface of the above embodiment is not limited to the surface formed by further processing the support body. For example, when the support body is in the attached state, if the surface on the support body of the part to which the bearing structure is attached can be regarded as being substantially parallel to the axis line direction of the support shaft due to a relation of bending of the entire support body in the length direction, for example, the surface on the support body can be used as the attaching surface without further processing the surface on the support body.

Further, as for the support body, in the above embodiment, the support body is constituted by the combination of the front top stay 3*a* and the support plate 4. Specifically, the support body of the above embodiment is constituted by combining the existing beam member of the loom and an attachment member to which the bearing structure is attached. However, in the present invention, the support body is not limited to such configuration.

For example, the attachment member formed into a plate shape or a beam shape may be attached to a pair of side frames so as to be bridged between the side frames, not to the existing beam member of the loom, and the support body may be constituted only by the attachment member. Alternatively, separately from the existing beam member of the loom, in the present invention, a dedicated beam-shaped member may be bridged between the pair of side frames, the plate-shaped attachment member like the support plate of the above embodiment may be attached to the dedicated beam-shaped member, and the support body may be constituted by the dedicated beam-shaped member and the plate-shaped attachment member.

Note that, in a case where the attachment member is a beam-shaped member or the support body includes the dedicated beam-shaped member, the attaching of the beam-shaped member to the side frames may be performed using the bolts for fixing, similar to the beam member of the above embodiment. In addition, in a case where the attachment member becoming the support body is a plate-shaped member, both end portions of the attachment member in the length direction may be bent in the plate thickness direction, and the attachment member may be attached to both the side frames in a form of fastening screw members (bolts and the like) inserted in the bent portions to the side frames.

(3) As for the bearing structure, in the above embodiment, the bearing structure 30 is formed as a single structure including the shaft support part 34 having the bearing 34*a* embedded therein and the base part 32 that is attached on the support plate 4. However, in the present invention, the bearing structure is not limited to the integrally formed structure, and may also be constituted by combining a shaft support part and a base part, which are formed as separate members.

In the above embodiment, the two bearing structures 30 are provided so as to support the rocking shaft 14 at two places between the support shafts 22 and 22. However, in the present invention, an appropriate number of the bearing structures may be provided according to the configuration of the rocking shaft.

The present invention is not limited to the above embodiment, and can be variously changed without departing from the gist of the present invention.

What is claimed is:

1. A loom comprising a pair of support shafts each provided to each of a pair of side frames and configured to rock, the side frames include a left side frame and a right side frame;

a rocking shaft connected to both the support shafts and bridged between the support shafts;

a bearing structure including a shaft support part to which a bearing configured to rotatably support the rocking shaft is provided, and a base part; and a support body provided to extend in a weaving width direction in a form of being bridged between the left and right side frames, and having an attaching surface, which is a surface to which the base part of the bearing structure is attached, the attaching surface being provided at a position spaced apart in the weaving width direction from both ends of the support body, the loom being characterized in that the support body has ends, wherein the support body includes a position adjusting surface being of a recess parallel to the attaching surface on at least one of both the ends of the support body, the position adjusting surface is provided at a position that does not overlap the attaching surface in the weaving width direction.

2. The loom according to claim 1, wherein the bearing structure is formed as a single structure.

* * * * *